US008161569B2

(12) United States Patent
Hudon et al.

(10) Patent No.: US 8,161,569 B2
(45) Date of Patent: Apr. 24, 2012

(54) CORE ASSEMBLY FOR AN ATHLETIC PROTECTIVE PAD

(75) Inventors: Jules Hudon, Chambly (CA); Phil Sioui, St-Jean sur Richelieu (CA)

(73) Assignee: Sport Maska Inc., Montreal, Quebec (CA)

( * ) Notice: Subject to any disclaimer, the term of this patent is extended or adjusted under 35 U.S.C. 154(b) by 813 days.

(21) Appl. No.: 12/219,563

(22) Filed: Jul. 24, 2008

(65) Prior Publication Data

US 2009/0025114 A1 Jan. 29, 2009

Related U.S. Application Data

(60) Provisional application No. 60/935,071, filed on Jul. 25, 2007.

(51) Int. Cl.
*A41D 13/00* (2006.01)

(52) U.S. Cl. ..... 2/22; 2/455

(58) Field of Classification Search ..... 2/16, 22, 2/23, 24, 455, 62, 911; 602/23, 26, 62
See application file for complete search history.

(56) References Cited

U.S. PATENT DOCUMENTS

| | | | | |
|---|---|---|---|---|
| 3,877,077 | A | 4/1975 | Chapdelaine | |
| 4,868,926 | A | 9/1989 | Lowson | |
| 5,093,931 | A | 3/1992 | LaBerge et al. | |
| 5,172,425 | A | 12/1992 | Smith | |
| 5,234,230 | A | 8/1993 | Crane et al. | |
| 5,328,652 | A | 7/1994 | Thomson | |
| 5,742,939 | A * | 4/1998 | Williams | 2/69 |
| 6,178,556 | B1 * | 1/2001 | Foreman et al. | 2/22 |
| 6,272,682 | B1 * | 8/2001 | Fullum | 2/22 |
| 6,588,167 | B2 * | 7/2003 | Chang | 52/590.1 |
| 6,789,264 | B2 * | 9/2004 | Budda | 2/22 |

FOREIGN PATENT DOCUMENTS

| | | |
|---|---|---|
| CA | 2263028 | 8/2000 |
| DE | 34 33 005 | 3/1985 |

* cited by examiner

*Primary Examiner* — Tejash Patel
(74) *Attorney, Agent, or Firm* — Norton Rose Canada LLP

(57) ABSTRACT

A core assembly for an athletic protective pad is provided. The core assembly comprises a backing member and a deflection shield overlaid on the backing member. The backing member includes a plurality of backing pieces that are assembled together. The deflection shield is located on the backing member using cooperating interlocking members provided on the deflection shield and at least one of the backing pieces. The core assembly may be inserted within an outer envelope to form a protective hockey goaltender leg pad.

25 Claims, 3 Drawing Sheets

CORE ASSEMBLY FOR AN ATHLETIC PROTECTIVE PAD

CROSS-REFERENCE TO RELATED APPLICATIONS

The present application claims priority on U.S. provisional patent application No. 60/935,071 filed Jul. 25, 2007, the entire contents of which are incorporated herein by reference.

FIELD OF THE INVENTION

The invention relates generally to athletic protective gear and, more particularly, to a core assembly for an athletic protective pad.

BACKGROUND ART

Athletic protective gear, such as hockey goaltender leg pads, provide crucial protection for the leg, ankle and foot by serving as a protective barrier between the goaltender's leg and the outer environment or playing area. Such gear is generally adapted to absorb the impact from a high speed object such as a hockey puck as well as protect the wearer from other potentially dangerous objects such as hockey sticks and skate blades that may come in contact with the goaltender's leg. Since goaltenders use their legs to block shots, significant protection must be provided while still permitting maneuverability.

Traditionally, hockey goaltender pads have been constructed by sewing leather into the form of longitudinal channels and stuffing the channels with deer hair to provide adequate impact resistance. These are typically quite rigid and heavy, and consequently, restrict the goaltender's speed and agility. Foam padding has also been used in the prior art for protective gear. Goaltender pads with foam padding typically have a core which comprises a plurality of pieces that are glued together. The glue contributes significantly to the weight of the pad and in cases where the glue is spread manually during manufacture of the pad, the amount of glue used may not always be consistent from pad to pad. Consequently, this can lead to notable weight variations between pads. Further, foam pads with sufficient shock absorbance are typically as heavy or even heavier than the deer hair pads. Conventional foam pads can also be excessively rigid and hinder the movement of the wearer.

German Patent Application No. 34 33 005 discloses a pad comprising a front part including synthetic material and laminated layers of foam material, and, a back part including a pad material and an outer layer. The foam pad comprises three adjacent longitudinal sections.

U.S. Pat. No. 5,328,652 discloses a protective leg gear including a protective leg pad made of foam which is molded in a single step to receive the leg and foot. The protective pad includes an ankle and foot area and a knee area which are contoured to closely approximate the shape of the ankle, foot and knee. A rigid intermediate member including a leg section and a foot section are disposed on the protective leg pad. An outer padding is also received on the rigid intermediate member.

U.S. Pat. No. 4,868,926 discloses a protective pad which includes multiple sections that are hinged together. Each section includes a front portion and a first and second side portions appended to the front portion. The adjacent edges of each adjacent pair of side portions are relieved to provide side relief gaps for enabling flexion of the leg pad during use.

Accordingly, there is a need to provide an improved athletic protective pad which is relatively lightweight, inexpensive and which does not significantly restrict the wearer's speed and agility.

SUMMARY OF THE INVENTION

It is therefore an object of the present invention to provide a core assembly for an athletic protective pad which addresses the above-mentioned concerns.

According to one broad aspect there is provided a core assembly for an athletic protective pad comprising: a backing member including a plurality of backing pieces assembled together; and a deflection shield overlaid on the backing member and located using cooperating interlocking members provided on the deflection shield and at least one of the backing pieces.

According to another aspect, there is provided a core assembly for an athletic protective leg pad comprising: a backing member having a forward facing surface and a plurality of tenons disposed on the forward facing surface; and a deflection shield overlaid on the backing member and located using cooperating holes provided in the deflection shield for receiving the tenons of the backing member.

According to a further aspect, there is provided a core assembly for an athletic protective leg pad covered by an outer envelope, the core assembly comprising: a backing member having a forward facing surface and a plurality of tenons disposed on the forward facing surface; and, a deflection shield overlaid on the backing member and located using cooperating holes provided in the deflection shield for receiving the tenons of the backing member.

There is also provided, in accordance with another aspect of the present invention, a protective hockey goaltender leg pad having an outer envelope and a core assembly within the outer envelope, the core assembly comprising a backing member including a plurality of backing pieces assembled together; and, a deflection shield overlaid on the backing member and frictionally engaged to the backing member using cooperating interlocking members provided on the deflection shield and at least one of the backing pieces.

There is further provided, in accordance with yet another aspect of the present invention, a method of assembling a protective hockey goaltender leg pad comprising the steps of: a) assembling a plurality of backing pieces to form a backing member; b) overlaying and interlocking a deflection shield on the backing member to form a core assembly; and c) inserting the core assembly into an outer envelope.

Further details of these and other aspects of the present invention will be apparent from die detailed description and figures included below which are included for illustrative purposes.

BRIEF DESCRIPTION OF THE DRAWINGS

Reference is now made to the accompanying figures, in which.

DETAILED DESCRIPTION OF PARTICULAR EMBODIMENTS

Figure 1:
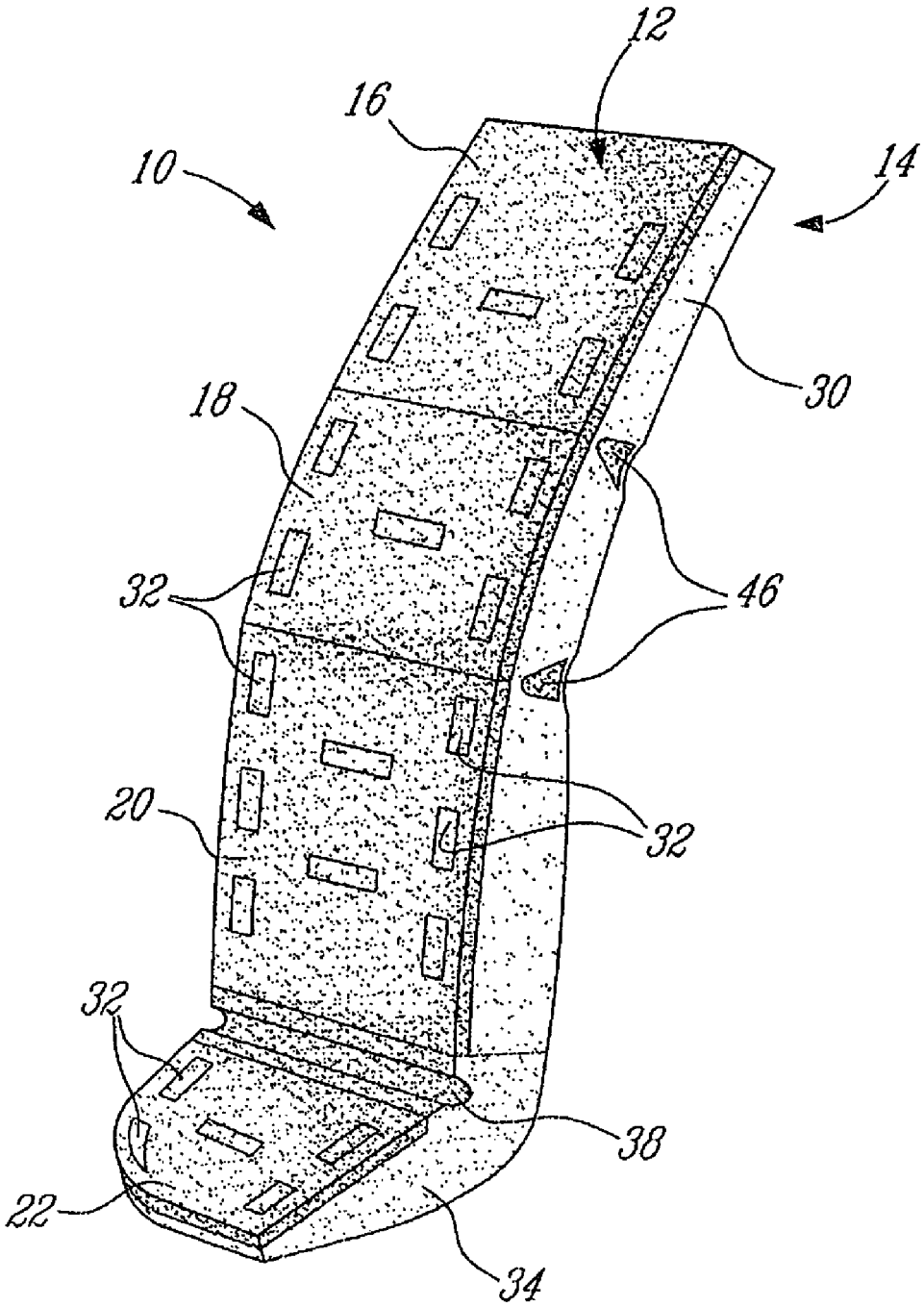
FIG. 1 is an isometric view of a core assembly for a protective leg pad according to one embodiment of the present invention.

Referring to FIG. 1, a core generally shown at 10 for a protective leg pad is shown. Such a core 10 is usually covered by a conventional outer envelope (not shown) to form the leg pad. The envelope may optionally include additional padding members formed thereon or attached thereto and means for securing the pad to a wearer's leg. Such a pad construction is suitable for use as a protective hockey goaltender leg pad.

Figure 2:
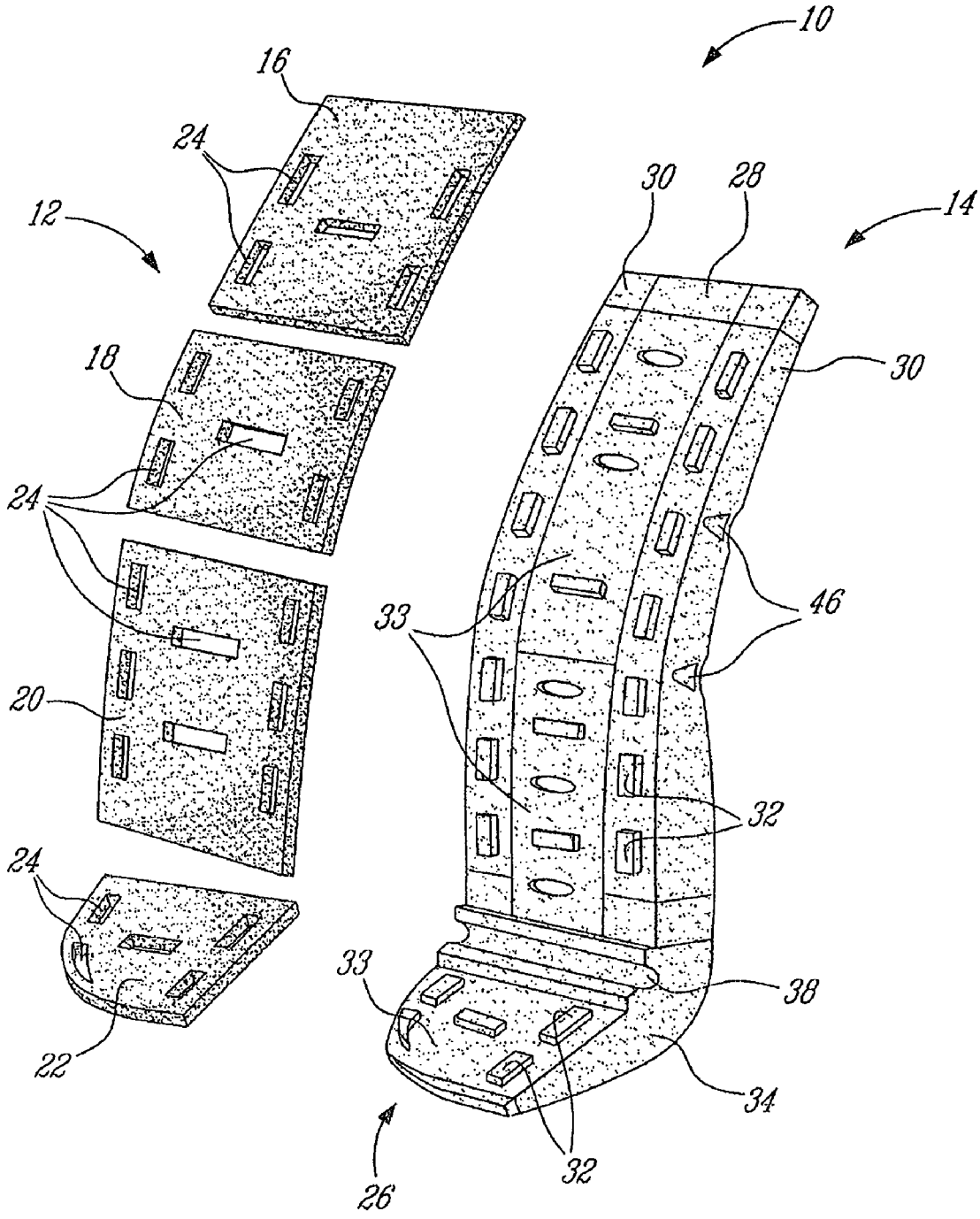
FIG. 2 is an isometric view of the core assembly of FIG. 1 whole a deflection shield is removed from a backing member.
Figure 3:
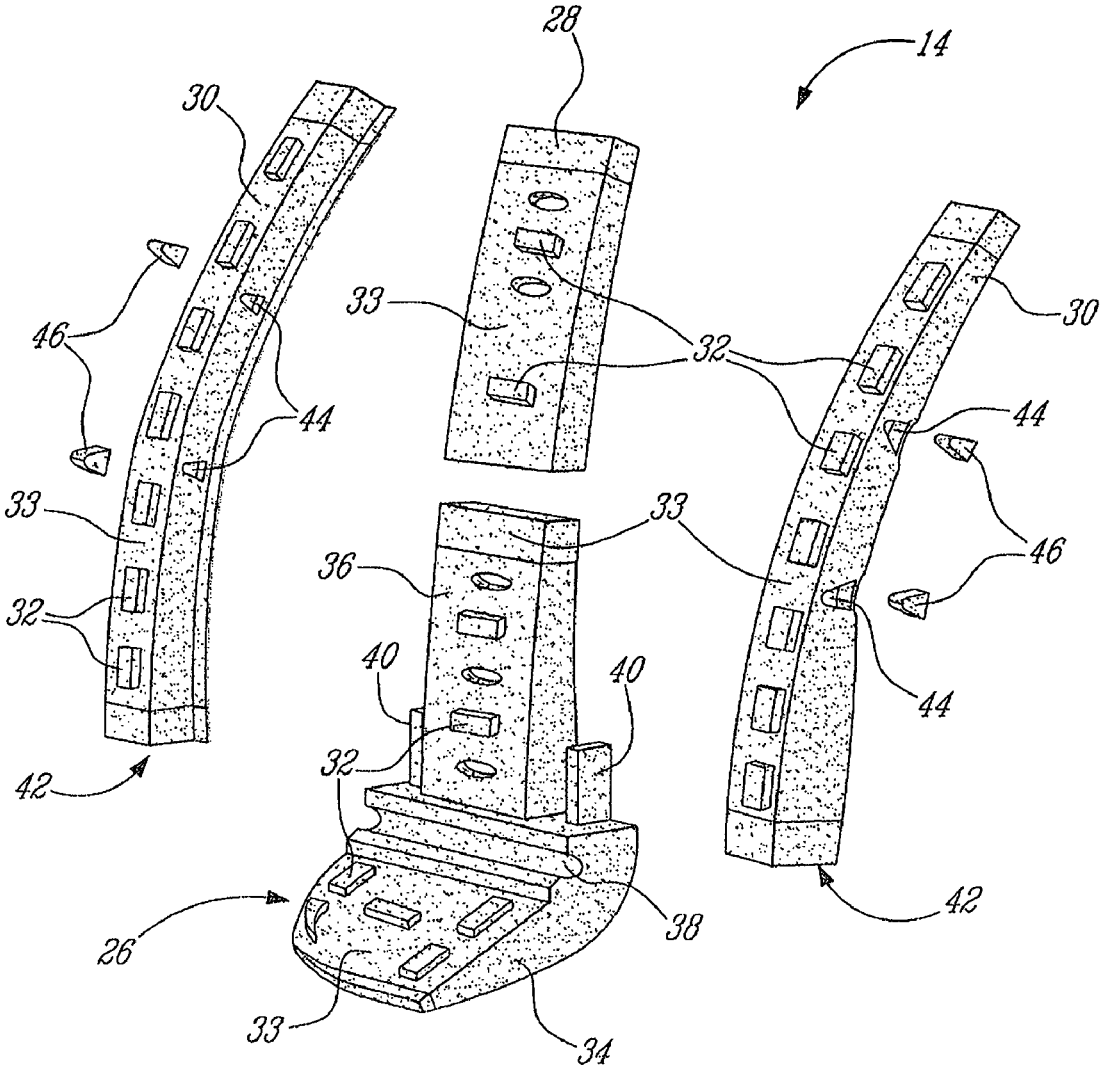
FIG. 3 is an isometric view of the backing member of FIG. 2 in a disassembled state.

Referring to FIGS. 1-3, the core 10 comprises a deflection shield generally shown at 12 and a backing member generally shown at 14. The deflection shield 12 includes a plurality of separate shield sections which are overlaid on and friction ally engaged to the backing member 14. The deflection shield 12 comprise a thigh shield section 16, a knee shield section 18, a shin shield section 20 and a foot shield section 22. The shield sections (16-22) extend substantially the entire width of the core 10. Each deflection shield section has a plurality of holes 24 defined therethrough.

The backing member 14 includes a plurality of backing pieces that are assembled and held together by the deflection shield 12. The backing member 14 comprises a lower piece generally shown at 26, an upper piece 28 and two lateral pieces 30. The pieces (26, 28 and 30) forming the backing member 14 all have tenons 32 protruding from a forward facing surface 33 of the backing member 14. The tenons 32 are positioned to cooperate with the corresponding holes 24 in the deflection shield 12. The upper piece 28 covers the thigh and the knee of a wearer and the lower piece 26 covers the shin, ankle and part of the skate boot of the wearer. The lower piece 26 has a foot portion 34 and a shin portion 36. The foot portion 34 has a transverse groove 38 and upwardly extending tenons 40 adapted to cooperate with corresponding holes (not shown) in a bottom face 42 of the lateral pieces 30.

The lower piece 26 may also comprise a leg channel (not shown) defined on a rear surface thereof for receiving the shin, ankle and foot of the wearer. The lower piece 26 may further comprise a channel insert (not shown) that is disposed within the leg channel.

The foot portion 34 of the lower piece 26 is designed to cover the foot of the wearer and has an increased width with respect to the remainder of the lower piece 26. The groove 38 defined on the foot portion 34 facilitates flexing or folding of the foot portion 34 near the ankle of the wearer. The discontinuity in the deflection shield 12 between the shin shield section 20 and the foot shield section 16 further facilitates flexure of the core 10 near the ankle of the wearer.

The lateral pieces 30 also have transverse flex holes 44 in which flex plugs 46 may be inserted. The flex holes 44 are located along the lateral pieces 30 at positions corresponding to just above and just below the knee of the wearer. The flex holes 44 facilitate flexure or folding of the backing member 14 near the knee of the wearer. Depending on the amount of flexibility that is desired, the flex plugs 46 may be inserted into at least one of the flex holes 44. The use of flex plugs 46 decreases the amount of flexibility of the core 10 by making the core 10 less pliable in comparison with leaving the flex holes 44 empty. The discontinuities in the deflection shield 12 between the knee shield section 18 and the thigh shield section 16 and also between the knee shield section 18 and the shin shield section 20, are in substantial alignment with their respective flex hole 44 so as to further facilitate flexure of the core 10 near the knee of the wearer.

All the separate components of the core 10 may be assembled together without the use of glue, other adhesives or the like. Firstly, and referring particularly to FIG. 3, the lower piece 26, upper piece 28 and lateral pieces 30 are assembled together to form the backing member 14. The lateral pieces 30 are assembled with the lower piece 26 by inserting the tenons 40 into the corresponding holes (not shown) in the bottom faces 42 of the lateral pieces 30. Preferably, the tenons 40 and the holes may be dimensioned so as to produce an interference fit and allow the pieces to be removably and frictionally engaged. Accordingly, the holes serve as mortices in which the tenons 40 are received. Next, and referring particularly to FIG. 2, the deflection shield 12 is overlaid and located on the backing member 14 in a similar fashion by inserting the tenons 32 into the corresponding holes 24. The thigh shield 16 and the knee shield 18 are assembled with the upper piece 28 and the two lateral pieces 30 of the backing member 14. The shin shield 20 is assembled with the shin portion 36 of the lower piece 26 and the two lateral pieces 30. Finally, the foot shield 22 is assembled with the foot portion 34 of the lower piece 26.

The tenons 32 on the backing member 14 and the corresponding holes 24 in the deflection shield 12 allow all the pieces of the core 10 to be located or properly positioned in relation to each other prior to the insertion of the core 10 into the envelope. Inserting the tenons 32 in the holes 24 produces an interlocking mechanism which prevents lateral movement between the deflection shield 12 and the backing member 14. In turn, this prevents the various pieces of the core 10 from shifting in relation to each other when the core 10 is inside the envelope and the protective leg pad is used by the wearer. In the case where an interference fit is provided between the tenons 32 and the holes 24, all the various pieces of the core 10 are advantageously frictionally engaged or snugly held together as one unit. Having all the pieces of the core 10 held together as one unit facilitates the insertion of the core 10 into the envelope during the assembly process and further prevents relative shifting during use.

It is apparent that all the various pieces of the core 10 described above can be fabricated using conventional manufacturing procedures and using suitable materials that would be apparent to a person skilled in the relevant art. For example the lower piece 26, the upper piece 28 and the two lateral pieces 30 and the flex plugs 46 are preferably molded from expanded polyethylene (EPE) foam or expanded polypropylene (EPP) foam. All the backing pieces may be made from the same material or from different materials depending on the performance requirements of the pad. The deflection shield 12 is preferably molded from high density foam as it provides most of the protection against the impact of high speed objects such as a hockey puck. Depending on the amount of flexibility that is desired, the flex plugs 46 may be produced from a different material or the same material as the lateral pieces 30. Accordingly, pads with customized flexibility may be produced through the use of suitable flex plugs 46. Alternatively, the flex holes 44 may be left empty for increased flexibility. The molded pieces are then trimmed and assembled to form the core 10.

The single material construction of the backing member 14 together with the geometry of the backing member 14 advantageously provides a relatively uniform weight distribution along the length of the core 10. This is beneficial in improving the maneuverability of the pad by the wearer and also contributes towards improving the balance and agility of the wearer.

The above description is meant to be exemplary only, and one skilled in the art will recognize that changes may be made to the embodiments described without department from the scope of the invention disclosed. For example, the present embodiment shows a backing member 14 having four separate backing pieces however this number could vary based on the design and performance requirements of the desired pad core. Therefore, it would also be within the scope of this invention to provide a core with a single-piece backing member. It is also apparent that the shape, size and number of tenons and corresponding holes could be varied and still achieve similar results. Further, a person skilled in the art would recognize that the construction of the core 10 of the present invention is not limited to leg pads for a hockey goaltender but is also applicable to other forms of athletic protective gear. Still other modifications which fall within the scope of the present invention will be apparent to those skilled in the art, in light of a review of this disclosure, and such modifications are intended to full within the appended claims.

What is claimed is:

1. A core assembly for an athletic protective pad comprising:

a backing member including a plurality of backing pieces assembled together; and a deflection shield overlaid on the backing member and located using cooperating interlocking members provided on the deflection shield and at least one of the backing pieces, the interlocking members comprising tenons and corresponding holes in which the tenons are received, at least some of the backing pieces also being interconnected with cooperating interlocking members.

2. The core assembly as defined in claim 1, wherein the tenons are provided on a forward facing surface of the backing member and the holes are provided in the deflection shield.

3. The core assembly as defined in claim 1, wherein the tenons and corresponding holes are dimensioned to provide a frictional engagement between the deflection shield and the backing member.

4. The core assembly as defined in claim 1, wherein the deflection shield comprises a plurality of shield sections.

5. A core assembly for an athletic protective pad, comprising a backing member including a plurality of backing pieces assembled together, and a deflection shield overlaid on the backing member and located using cooperating interlocking members provided on the deflection shield and at least one of the backing pieces, the backing pieces including a lower piece, an upper piece and two lateral pieces, the lower piece and the two lateral pieces also being provided with cooperating interlocking members.

6. The core assembly as defined in claim 5, wherein the two lateral pieces each comprise at least one flex hole for facilitating flexure of the backing member near a knee region of a wearer.

7. The core assembly as defined in claim 6, wherein each of the two lateral pieces further comprise a flex plug inserted into the at least one flex hole.

8. The core assembly as defined in claim 5, wherein the lower piece of the backing member comprises a groove for facilitating flexure of the backing member near an ankle region of a wearer.

9. A core assembly for an athletic protective leg pad comprising:

a backing member having a forward facing surface and a plurality of tenons disposed on the forward facing surface, the backing member including at least one flex hole for facilitating flexure of the backing member; and a deflection shield overlaid on the backing member and located using cooperating holes provided in the deflection shield for receiving the tenons of the backing member.

10. The core assembly as defined in claim 9, wherein the tenons and corresponding holes are dimensioned to provide a frictional engagement between the deflection shield and the backing member.

11. The core assembly as defined in claim 9, wherein the backing member further comprises a flex plug inserted within the at least one flex hole, the flex plug comprising a same material as the backing member.

12. A core assembly for an athletic protective leg pad comprising:

a backing member having a forward facing surface and a plurality of tenons disposed on the forward facing surface; and a deflection shield overlaid on the backing member and located using cooperating holes provided in the deflection shield for receiving the tenons of the backing member wherein the backing member comprises a lower piece, an upper piece and two lateral pieces assembled together.

13. The core assembly as defined in claim 12, wherein the two lateral pieces are frictionally engaged to the lower piece.

14. The core assembly as defined in claim 12, wherein the lower piece, the upper piece and the two lateral pieces are made from the same material.

15. A method of assembling a protective hockey goaltender leg pad comprising the steps of:

a) assembling a plurality of backing pieces to form a backing member;

b) overlaying and interlocking a deflection shield on the backing member to form a core assembly; and c) inserting the core assembly into an outer envelope.

16. The method as defined in claim 15 wherein the overlaying and locating step b) further comprises frictionally engaging the deflection shield to the backing member.

17. The method as defined in claim 15 wherein the assembling step a) further comprises frictionally engaging at least two of the backing pieces together.

18. The core assembly as defined in claim 5, wherein the upper piece is configured to cover the thigh and knee of a wearer, and the lower piece is configured to cover the shin, ankle and part of a skate boot of the wearer.

19. The core assembly as defined in claim 7, wherein each lateral piece is made of a different material than that of the flex plug inserted into the at least one flex hole.

20. The core assembly as defined in claim 7, wherein each lateral piece is made of a same material than that of the flex plug inserted into the at least one flex hole.

21. The core assembly as defined in claim 7, wherein the lower piece, upper piece, lateral pieces and flex plugs are made of expanded polyethylene (EPE) foam or expanded polypropylene (EPP) foam.

22. The core assembly as defined in claim 9, wherein the backing member further comprises a flex plug inserted within the at least one flex hole, the flex plug comprising a different material than that of the backing member.

23. The core assembly as defined in claim 6, wherein the deflection shield includes a discontinuity in substantial alignment with each flex hole to facilitate flexure of the core assembly.

24. The core assembly as defined in claim 9, wherein the deflection shield includes a discontinuity in substantial alignment with each flex hole to facilitate flexure of the core assembly.

25. The method as defined in claim 15, wherein steps a) and b) are performed without the use of adhesive.

* * * * *